US009780448B1

(12) United States Patent
Meagher et al.

(10) Patent No.: US 9,780,448 B1
(45) Date of Patent: Oct. 3, 2017

(54) TRUE PATH BEAM STEERING

(71) Applicant: The United States of America as represented by the Secretary of the Navy, Washington, DC (US)

(72) Inventors: Christopher J. Meagher, San Diego, CA (US); Randall B. Olsen, Carlsbad, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 693 days.

(21) Appl. No.: 14/041,137

(22) Filed: Sep. 30, 2013

(51) Int. Cl.

| | |
|---|---|
| ***H01Q 3/12*** | (2006.01) |
| ***H01Q 3/00*** | (2006.01) |
| ***H01Q 3/36*** | (2006.01) |
| ***H01P 1/18*** | (2006.01) |

(52) U.S. Cl.
CPC ..... *H01Q 3/36* (2013.01); *H01P 1/182* (2013.01); *H01P 1/184* (2013.01)

(58) Field of Classification Search
USPC ..... 342/81, 157, 372, 373, 374; 327/258, 327/261; 370/335
See application file for complete search history.

(56) References Cited

U.S. PATENT DOCUMENTS

2012/0039366 A1 2/2012 Basit et al.
2013/0230025 A1 9/2013 Proctor, Jr.

OTHER PUBLICATIONS

Yegnanarayanan, S., and B. Jalali, "Wavelength-Selective True Time Delay for Optical Control of Phased-Array Antenna." IEEE Photonics Technology Letters, Aug. 2000, p. 1049.

*Primary Examiner* — Dao Phan
(74) *Attorney, Agent, or Firm* — SPAWAR Systems Center Pacific; Kyle Eppele; J. Eric Anderson

(57) ABSTRACT

The present invention is an apparatus for shifting the phase of an radiofrequency signal. The device has an input line and an output line. An input switch is connected to the input line. The input switch is has several input throws. An output switch is connected to the output line. The output switch has several output throws which correspond to the input throws. The apparatus also has several phase shift lines. Each phase shift line has a true path length that is different from the true path lengths of the other phase shift lines.

20 Claims, 4 Drawing Sheets

TRUE PATH BEAM STEERING

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil. Reference Navy Case No. 101777.

BACKGROUND

1. Field

This invention relates to the field of antenna arrays, and more specifically, to a high-gain antenna array in which the beam direction can be steered without the use of classical phase shifters and beamformer circuitry.

2. Background

An antenna is a device that indiscriminately broadcasts a signal in every direction and in a pattern referred as a "radiating signal pattern." The direction of a signal sent by a single antenna cannot be controlled. Antenna arrays are groupings of antennas that control the direction of a signal by enhancing the signal in a desired direction while diminishing the signal in non-desired directions. Signals transmitted along such a directional path are referred to as "beams".

Beam control is important for coordinating communications. Antennas may be used to communicate between one or more moving stations, such as ships, aircraft, satellites and ground stations. Communication with moving objects requires that the beam path be continuously and precisely adjusted, or the object will lose communication. Precise beam control may also be necessary to prevent a signal from being intercepted.

Antennas in arrays are passive devices through which a beam can be mechanically or electronically steered. Antennas are mechanically steered by strategic positioning or by geometric alterations. Antennas are electronically steered by altering the transmission signal fed into them. Electronic steering varies the phase and amplitude of the electronic signal fed into each antenna of the array. This type of array is referred to as a "phased antenna array".

A major component of the phased antenna array is the feed assembly component. The feed assembly receives the incoming radiofrequency (RF) signal for the entire array and splits it between multiple signal-altering components. Signal-altering components include phase shifters, amplifiers and attenuators. Amplifiers increase signal strength and attenuators reduce it. The beam direction for each composite phased antenna array is a result of the output signals emitted by each antenna in the array.

Phase shifter components direct the signal down multiple circuit paths of different lengths within the phased antenna array. A switching controller determines which path the signal goes down by opening and closing multiple switches for each path. The different paths delay the signal by varying amounts, altering the phase. The greater the number of paths at varying lengths, the more precise the switching capability.

One problem with conventional phase shifters known in the art is a limitation on the number and length of lines it is practical to put into a phase shifter. Increasing the number of lines requires complex circuitry and processing capability, adding to cost and energy requirements. Increasing the number of switches between the input and output lines increases the likelihood of component failure.

Another problem known in the art is referred to as "beam squint." Beam squint refers to the problem of maintaining a consistent beam position over a wide range of frequencies without introducing error inherent in digital phase shifting.

A significant cause of beam squint is that classical phase shifters must approximate the path for steering a beam in modulo $2\pi$ phase mode. The modulo $2\pi$ approximation range is a limitation on accurate approximation. This error is introduced at high and low frequencies. With conventional phase shifters, errors may be produced during phase shift of up to $360/2^n$ degrees, where n is the number of path lengths within the phase shifter. A conventional phase shifter with four paths may introduce a phase angle error of up to 22.5 degrees. Phase errors can increase the amount of power wasted, and angle errors can lead to unacceptably poor broadband performance.

There is an unmet need for a phased antenna array that provides more precise beam steering capability, that has failure-resistant components, and that is less prone to beam squint error.

SUMMARY OF THE INVENTION

The present invention is an apparatus for shifting the phase of a radiofrequency signal. The device has an input line and an output line. An input switch is connected to the input line. The input switch is has several input throws. An output switch is connected to the output line. The output switch has several output throws which correspond to the input throws. The apparatus also has several phase shift lines. Each phase shift line has a true path length that is different from the true path lengths of the other phase shift lines.

DETAILED DESCRIPTION

Figure 1:
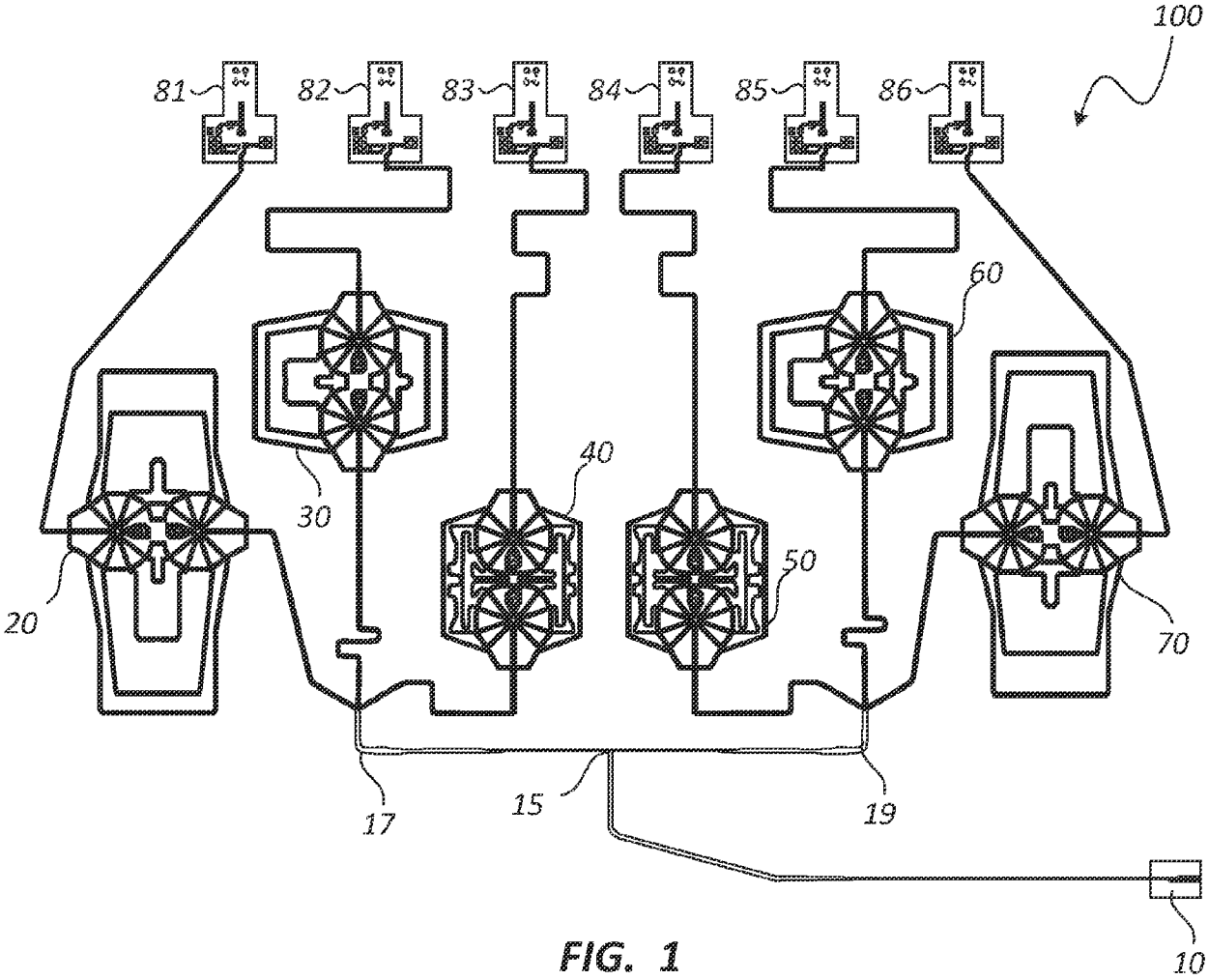
FIG. 1 illustrates an exemplary true path beam steering system.

FIG. 1 illustrates an exemplary embodiment of a true path beam steering system 100. The elements of the true path beam steering system 100 shown in FIG. 1 includes a radiofrequency (RF) signal input 10, a binary splitter 15, a pair of three-way splitters 17 and 19, six phase shifters 20, 30, 40, 50, 60 and 70, and six amplifiers 81, 82, 83, 84, 85, and 86.

In the exemplary true path beam steering system 100 shown in FIG. 1, an RF signal input 10 passes through a binary splitter 15. The output of binary splitter 15 is in turn passed through a pair of three-way splitters 17 and 19. The resulting six-way split signal inputs are then presented to six phase shifters 20, 30, 40, 50, 60 and 70. Finally each of the six phase shifters 20, 30, 40, 50, 60 and 70 feeds one of a series of amplifiers 81, 82, 83, 84, 85, and 86.

Splitters 15, 17 and 19 are devices capable of splitting a single signal into two or more signals. The exemplary embodiment shown in FIG. 1 utilizes a binary splitter 15 and a pair of three-way splitters 17 and 19 to create a six-way split of RF signal input 10. In various alternative embodiments, different numbers and configurations of splitters may be used to split RF signal input 10 into a different number of split signals, ranging from two to about five hundred.

Phase shifters 20, 30, 40, 50, 60 and 70 each comprise a plurality of physical lines through which an RF signal input 10 passes, resulting in a time delay of that signal as compared to a reference signal that does not pass through the physical lines. While the exemplary embodiment of the true path beam steering system 100 shown utilizes six phase shifters 20, 30, 40, 50, 60 and 70, in alternative embodiments a different number of phase shifters may be utilized to accommodate a different number of split signals ranging from two to about five hundred. Additionally, in alternative embodiments up to five phase shifters may be used in serial on the same split signal to create a more complex time delay.

The exemplary true path beam steering system 100 shown in FIG. 1 provides highly accurate beam steering. Unlike classical phase shifting, which is typically limited to 4 or 5 bits (22.5 or 11.25 degrees) of accuracy, the exemplary embodiment provides highly accurate beam steering capability in which "beam squint" error is controlled.

The accuracy of true path beam steering system 100 is limited only by transmission line manufacturing tolerances and switch manufacturing tolerances. Phase accuracy on the order of 1 degree (equivalent of 8 or 9 bits) or better may be possible. The high degree of phase accuracy of true path beam steering system 100 is critical for producing low-side lobe antenna patterns, as are needed for applications where Low Probability of Intercept (LPI), Low Probability of Detection (LPD), or Anti-Jamming (AJ) capabilities are important.

Figure 2:
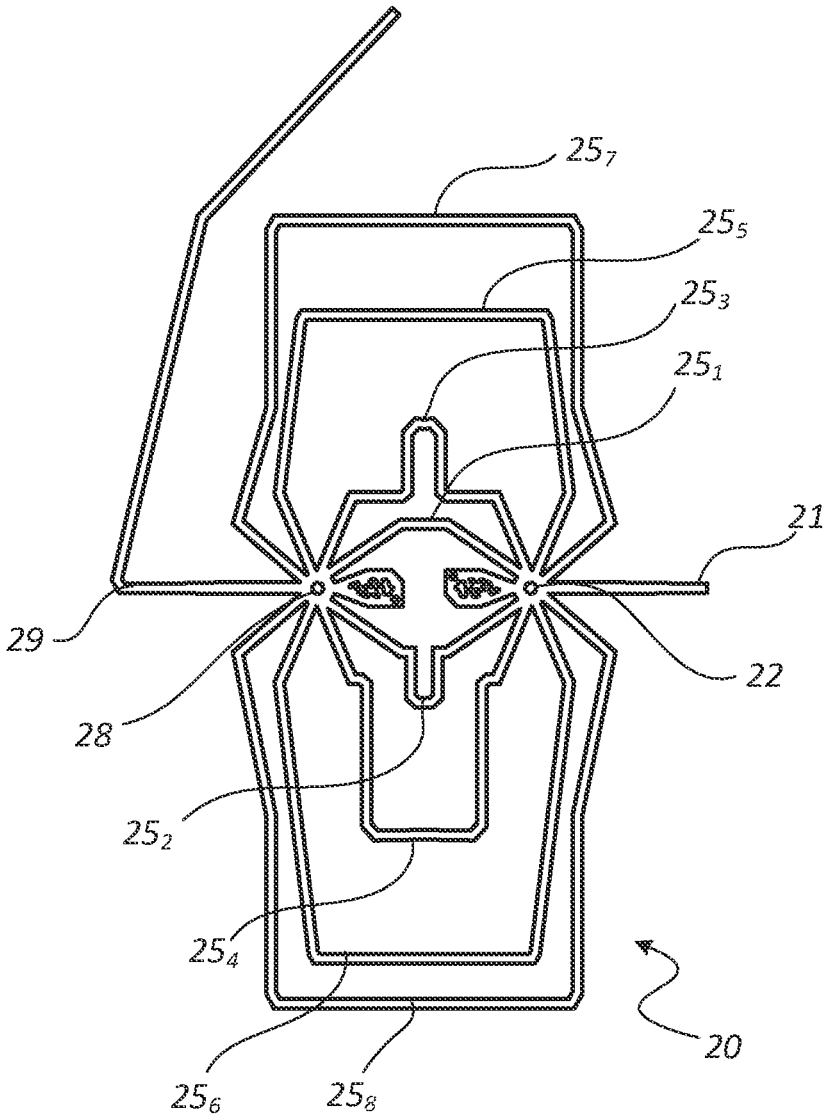
FIG. 2 illustrates an exemplary embodiment of a phase shifter used in a true path beam steering system.

FIG. 2 illustrates an exemplary phase shifter 20 used in a true path beam steering system 100. The exemplary embodiment shown includes a transmission line 21, an input switch 22, phase shift lines $\mathbf{25}_1$, $\mathbf{25}_2$, $\mathbf{25}_3$, $\mathbf{25}_4$, $\mathbf{25}_5$, $\mathbf{25}_6$, $\mathbf{25}_7$, and $\mathbf{25}_8$, output switch 28 and output line 29.

In the exemplary embodiment shown in FIG. 2, the split signal input enters on transmission line 21 to an input switch 22, which directs the split signal input to any of eight phase shift lines $\mathbf{25}_1$, $\mathbf{25}_2$, $\mathbf{25}_3$, $\mathbf{25}_4$, $\mathbf{25}_5$, $\mathbf{25}_6$, $\mathbf{25}_7$, or $\mathbf{25}_8$. Note that the various phase shift lines $\mathbf{25}_i$ have different physical lengths relative to each other. The various phase shift lines $\mathbf{25}_i$ carry the split signal input to collecting terminals in an output switch 28, which selects the particular output line that is carrying the signal (as directed by input switch 22), and connects that particular output line to an output line 29. In this embodiment, eight beam positions can be created by the eight phase shift lines $\mathbf{25}_i$. In alternate contemplated embodiments, phase shift lines $\mathbf{25}_i$ may number from four to one hundred.

Classical phase shifters operate in modulo $2\pi$ phase mode. These phase shifters approximate beam steering phases by trying to equal the phase in a modulo $2\pi$ framework. The modulo $2\pi$ approximation may deviate significantly in a true path or total phase sense. This disparity leads to unacceptably poor broadband performance.

In the exemplary embodiment shown in FIG. 2, the net effect of the split signal input having traversed the phase shifter 20 is an increase in the true time delay that when translated into phase can be much larger than $2\pi$.

Phase shifter 20 uses delays that are physical shift-line-paths (herein also identified as "true paths") and not digital approximations. In the exemplary embodiment shown, the lengths of the true paths are capable of being adjusted to take into account factors that include, but are not limited to, actual size of the phased antenna array, the number of radiating antennas in the phased antenna array, antenna spacing, variations in antenna spacing, and frequency ranges.

Unlike phase shifters which rely on digital approximations and are limited to lengths of $2\pi$, phase shifter 20 eliminates errors at high and low frequencies caused by the artificial $2\pi$ limitation inherent in methods known in the art.

In true path beam steering system 100, phase errors may be reduced to very low levels. Errors within true path beam steering system 100 are caused by fabrication tolerances in lines and switches. Because phase shifter 20 uses physically true paths, the narrow bandwidth nature of classical phase shifting (i.e. only getting the modulo $2\pi$ phase correct) is overcome.

In various embodiments, phase shifter 20 may enable beam steering with very large fractional bandwidths, ranging from a factor of about 30% to multiple decades.

FIG. 2 illustrates that phase shift lines $\mathbf{25}_i$ can be realized in a variety of embodiments including, but not limited to, microstrip, stripline, co-planar waveguide and waveguide transmission lines. In the present embodiment, phase shift lines $\mathbf{25}_i$ are microstrip lines, but may be any other form or material known in the art from which phase shift lines can be fabricated.

In alternative embodiments input switch 22 and output switch 28 may be any type of switch known in the art, including a semi-conductor, electro-mechanical, PIN or micro-electronic mechanical systems (MEMS) switch.

In the embodiment shown in FIG. 2, the input switch 22 and output switch 28 are configured as single-pole, eight-throw ("1 by 8") switches ("1 by N" known in art) but in various alternate embodiments may be arranged in any configuration that may accommodate individual selection of lines within the phase shifter. The exemplary embodiment utilizes a commercially available embodiment of a surface mount package switch is manufactured by Hittite Microwave (www.hittite.com). The switch model HMC321LP4 (E) is a broadband, non-reflective GaAs MESFET SP8T switch in a low-cost leadless-surface mount package.

Figure 3:
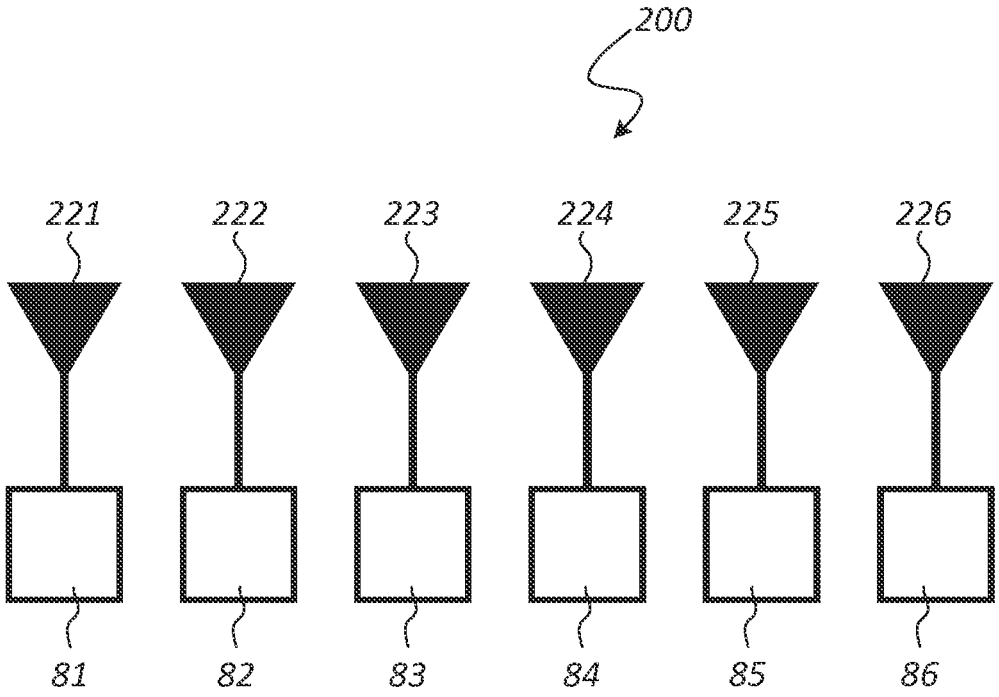
FIG. 3 illustrates a schematic of amplifiers operatively coupled with radiating elements.

FIG. 3 is a schematic of amplifiers of the exemplary true path beam steering system 100 operatively coupled with radiating elements. The exemplary embodiment in FIG. 3 includes six amplifiers 81, 82, 83, 84, 85, and 86 and corresponding radiating elements 221, 222, 223, 224, 225, and 226 of an electronically steered antenna array 200.

In various alternate embodiments, radiating elements 221, 222, 223, 224, 225, and 226 may have alternate configurations, known in the art as "steerable RF arrays". In one alternative embodiment, radiating elements 221, 222, 223, 224, 225, and 226 may be slot-coupled patches. In another alternative embodiment, radiating elements 221, 222, 223, 224, 225, and 226 may be pin-feed patches. Various alternative embodiments may also include more or fewer radiating elements or alternate types of radiating elements.

Figure 4:
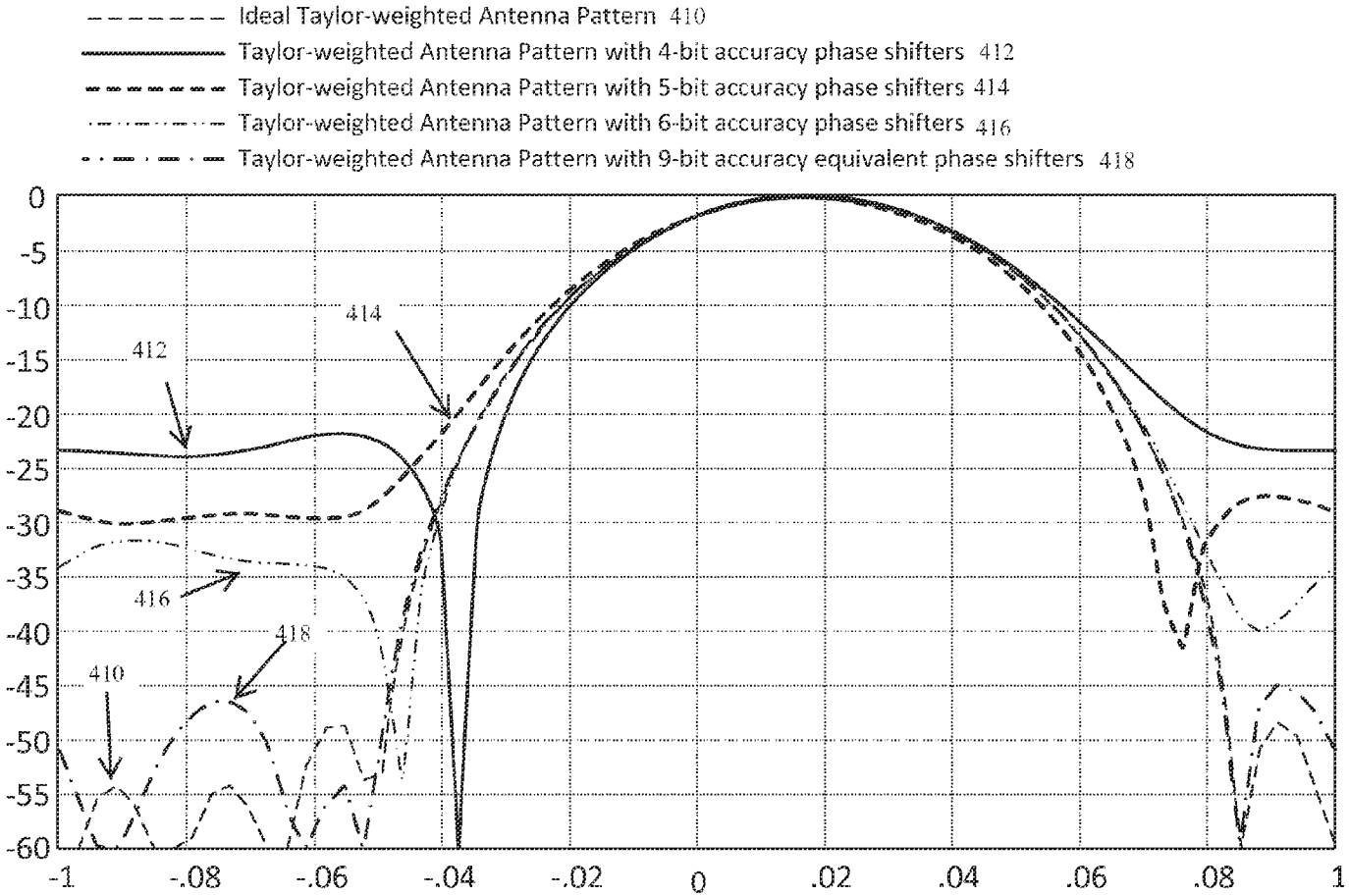
FIG. 4 illustrates antenna pattern comparisons between an ideal pattern, those generated via more classical phase shifting approaches, and that according to the detailed exemplary invention description herein.

FIG. 4 illustrates antenna pattern comparisons between an ideal pattern, those generated via more classical phase shifting approaches, and that according to the detailed exemplary invention description herein. In this figure, the vertical "y" axis represents normalized antenna gain (dB) and the horizontal "x" axis is azimuth angle from broadside (degrees). Ideal pattern 410 corresponds to a 6-element array that is ideal Taylor weighted resulting in with −45 dB weighting and generating −48 dB side lobes. Patterns 412, 414 and 416 are generated with the same ideal Taylor weighting but are created with classical 4-bit, 5-bit, and 6-bit accuracy phase shifters, respectively. Finally, pattern 418 also utilizes the ideal Taylor weighting but couples this with the exemplary phase shifting and beam steering invention approach as described in this detailed description.

With respect to "ideal" generated antenna pattern 410, the Taylor weighted antenna array used has elements near the center of the array that are assigned large signal amplitudes and has elements of progressively decreased amplitudes toward the edges of the array.

Ideal pattern 410 reflects phase errors that are essentially zero, and a beam steered to 10 degrees off of normal to avoid computational issues that occur with 0 degree beam pointing. The calculation used for this exemplary embodiment assumes ideal magnitude weights and, as indicated, these weight assumptions were used for all subsequent antenna patterns generated. The assumed antenna element spacing within the array is one-half wavelength. When no phase errors are present, highly suppressed side lobes are made feasible by the use of the Taylor weighting.

FIG. 4 further illustrates the effect of using low-bit (i.e. less accurate) classical phase shifters on beam steering. The first output of this approach is identified in the figure as 412 and is one generated with classical assumed 4-bit accuracy phase shifters. Although a −45 dB ideal Taylor weighting is assumed, the side lobes of the 4-bit approach are worse than −25 dB. This indicates that the side lobes utilize 23 dB more power, i.e. 200× more power than in the ideal approach illustrated by pattern 410 of FIG. 4.

Similarly, graph line 414 of FIG. 4 is generated with classical assumed 5-bit accuracy phase shifters. Even though a −45 dB Taylor weighting is assumed, the side lobes are worse than −30 dB. This indicates that the side lobes are utilizing 18 dB more power (i.e. 60× more power) than the ideal case illustrated as 410 in the figure.

Finally, the output 416 of FIG. 4 uses the same array configuration as before, but with assumed 6-bit accuracy phase shifters. Notice that even with the −45 dB Taylor weighting, the side lobes are worse than −35 dB. This indicates that the side lobes are seeing 13 dB more power (i.e. 20× more power) than the ideal embodiment illustrated as 410 in the figure. The 6-bit phase shifters represent high performance (and cost) commercially available phase shifters.

True path beam steering system 100 achieves the results of the graph line 418 also labeled "9-bit" in FIG. 4. The approach uses the same array configuration as the ideal approach of pattern 410, but with the assumed 9-bit (equivalent) accuracy phase shifters of the present invention. In this exemplary embodiment, the side lobes are suppressed to −45 dB, which is near the 3 dB level of the ideal embodiment of 410.

As illustrated in FIG. 4, the performance of true path beam steering system 100 can be improved to achieve a result that is 20 dB more efficient (i.e. 100× more power) than 4-bit phase shifters and 15 dB more efficient (30× more power) than 5-bit phase shifters with regard to side-lobe suppression.

In the exemplary embodiment shown in FIG. 1, the number of antenna beams is equivalent to the number of possible true path lengths that lead to an antenna element of the antenna array. Also in that embodiment, the number of beam positions is a function of the number of potential switch positions (i.e., "throws") of either switch used to make up each phase shifter. If "n" beams are required, the phase shifter may be made with single pole, n-throw input and output switches.

It will be understood that many additional changes in the details, materials, steps and arrangement of parts, which have been herein described and illustrated to explain the nature of the invention, may be made by those skilled in the art within the principal and scope of the invention as expressed in the appended claims.

What is claimed:

1. A phase shifter apparatus comprising:

an input line;

an output line;

an input switch, wherein said input switch is configured with a plurality of input throws and wherein said input switch is operatively coupled to said input line;

an output switch, wherein said output switch is configured with a plurality of output throws corresponding to said plurality of input throws and is operatively coupled to said output line; and a plurality of phase shift lines through which an input radiofrequency (RF) signal may pass, wherein the plurality of phase shift lines are disposed between the input throws and the output throws, wherein the plurality of phase shift lines have different physical, true path lengths from each other, and wherein at least one of said true path lengths is greater than a wavelength of the input RF signal.

2. The apparatus of claim 1 wherein each true path length represents a path that results in a time delay that produces a phase shift and a phase slope.

3. The apparatus of claim 1 wherein the number of different true path lengths corresponds to the number of possible beam positions generated by a phased antenna array.

4. The apparatus of claim 1 wherein the true path length of each phase shift line is variably determined by a desired beam steering angle from a reference angle of a phased antenna array.

5. The apparatus of claim 1 wherein each of the different true path lengths is variably determined by a distance between antenna elements in a phased antenna array.

6. The apparatus of claim 1, wherein the number of said plurality of phase shift lines is equal to eight.

7. The apparatus of claim 1, wherein said plurality of phase shift lines may be selected from the group consisting of microstrip, stripline, co-planar waveguide and waveguide transmission lines.

8. The apparatus of claim 1, wherein said input switch and said output switch may be selected from the group consisting of semiconductor, electro-mechanical, PIN and microelectronic mechanical systems switches.

9. A phased antenna array system for steering a beam path comprising:

an RF signal input;

a plurality of individual antenna elements, wherein each of said plurality of individual antenna elements is placed at a distance from each of said other plurality of individual antenna elements;

a plurality of amplifiers wherein said plurality of amplifiers are operatively coupled to said plurality of individual antenna elements;

a plurality of phase shifters operatively coupled with said plurality of amplifiers, wherein each of said plurality of phase shifters comprises:

an input line;

an output line;

an input switch, wherein said input switch is configured with a plurality of input throws and wherein said input switch is operatively coupled to said input line;

an output switch, wherein said output switch is configured with a plurality of output throws corresponding to said plurality of input throws and is operatively coupled to said output line; and a plurality of phase shift lines through which the RF signal input may pass, wherein the plurality of phase lines are disposed between the input throws and the output throws, wherein said plurality of phase shift lines have different true path, physical lengths from each other, and wherein at least one of said true path lengths is greater than a wavelength of the RF signal input; and at least one splitter operatively coupled with each of said plurality of phase shifters, wherein said at least one splitter is operatively coupled to said RF signal input.

10. The system of claim 9 wherein each true path length represents a path that results in a time delay that produces a phase shift and a phase slope.

11. The system of claim 9 wherein the number of different true path lengths corresponds to the number of possible beam positions generated by a phased antenna array.

12. The system of claim 9 wherein each of said true path lengths is variably determined by a distance between said plurality of individual antenna elements.

13. The system of claim 9 wherein said true path length of each of said phase shift lines is variably determined by a desired beam steering angle from a reference angle of a phased antenna array.

14. The system of claim 9, wherein the number of said plurality of phase shift lines is equal to eight.

15. The system of claim 9, wherein said plurality of phase shift lines may be selected from the group consisting of microstrip, stripline, co-planar waveguide and waveguide transmission lines.

16. The system of claim 9, wherein said input switch and output switch may be selected from the group consisting of semiconductor, electro-mechanical, PIN and micro-electronic mechanical systems switches.

17. A method for phase-shifting a signal, comprised of the steps of:

inputting an RF signal through a phase shifter input line;

switching an input switch to select a true path phase shift line from a plurality of true path phase shift lines wherein said plurality of phase shift lines have different true path, physical lengths from each other;

switching an output switch to select said input switch-selected phase shift line from said plurality of phase shift lines;

passing said RF signal through said phase shift line to phase-shift said RF signal; and outputting said RF signal through a phase shifter output line.

18. The method of claim 17 which further includes the step of determining the number of antenna elements of a phased antenna array and equating the number of phase shift lines to a number of desired beam positions.

19. The method of claim 18 which further includes the step of determining a beam steering angle from a reference angle of a phased antenna array and conforming said plurality of said true path lengths to said beam steering angle.

20. The method of claim 19 which further includes the step of confirming said plurality of true path line lengths are equivalent to a plurality of spacing lengths between antenna elements of a phased antenna array.

* * * * *